US005186318A

United States Patent [19]

Oestreich et al.

[11] Patent Number: 5,186,318

[45] Date of Patent: Feb. 16, 1993

[54] AIR TIGHT CONTAINER

[75] Inventors: Curtis J. Oestreich, East Windsor, N.J.; Joseph S. Cannizzaro, South Salem, N.Y.; Joseph S. Wargo, Mountain Lakes, N.J.

[73] Assignee: Estee Lauder, Inc., New York, N.Y.

[21] Appl. No.: 203,592

[22] Filed: Jun. 2, 1988

Related U.S. Application Data

[63] Continuation of Ser. No. 594,006, Mar. 27, 1984, which is a continuation-in-part of Ser. No. 480,620, Mar. 30, 1983.

[51] Int. Cl.[5] ..... A45D 40/00

[52] U.S. Cl. ..... 206/37; 206/811

[58] Field of Search ..... 220/344; 206/8, 37, 206/811; 215/354

[56] References Cited

U.S. PATENT DOCUMENTS

| | | | |
|---|---|---|---|
| 1,641,650 | 9/1927 | Walker | 206/811 |
| 2,075,987 | 4/1937 | Houck | 206/811 |
| 2,737,189 | 3/1956 | Morningstar et al. | 220/344 X |
| 2,848,145 | 8/1958 | Livingstone | 215/DIG. 1 |
| 2,852,054 | 9/1958 | Motley | 220/306 |
| 2,917,198 | 12/1959 | Beall, Jr. | 215/329 |
| 3,144,167 | 8/1964 | Schultz | 215/354 X |
| 4,132,306 | 1/1979 | Margolin | 206/37 |
| 4,289,232 | 9/1981 | Seibel et al. | 206/37 |
| 4,331,168 | 5/1982 | Hatakeyama | 206/37 |

*Primary Examiner*—Steven M. Pollard
*Attorney, Agent, or Firm*—Blum Kaplan

[57] ABSTRACT

A container particularly well suited for maintaining an air-tight seal for protecting cosmetic compositions stored therein is provided. The container includes an openable top hinged to a container bottom, one of which includes a deformable flange. The flange is formed of a thin deformable material which is deflected towards the opposite member when the container top is closed. This compression of the dish flange effectively provides an air-tight seal when the container is held in a closed position.

6 Claims, 3 Drawing Sheets

FIG. 1
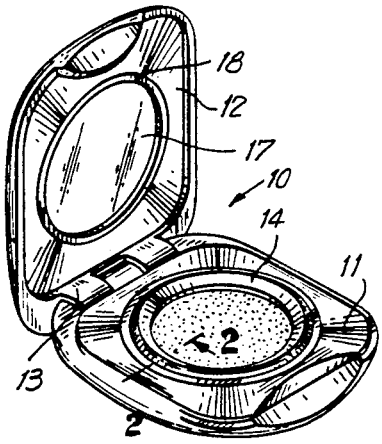
FIG. 5
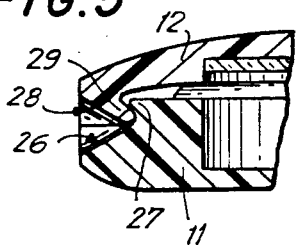
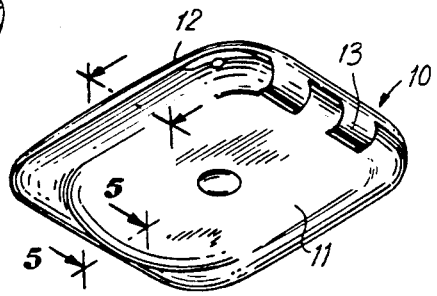
FIG. 3
FIG. 2
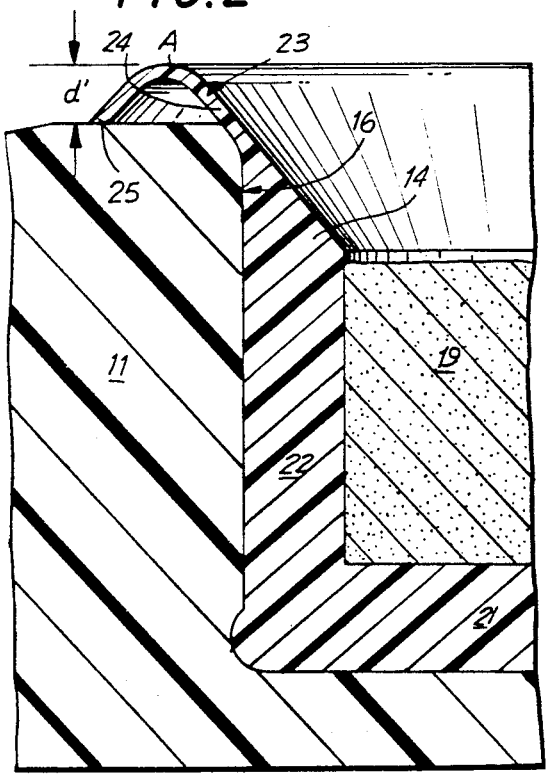
FIG. 4
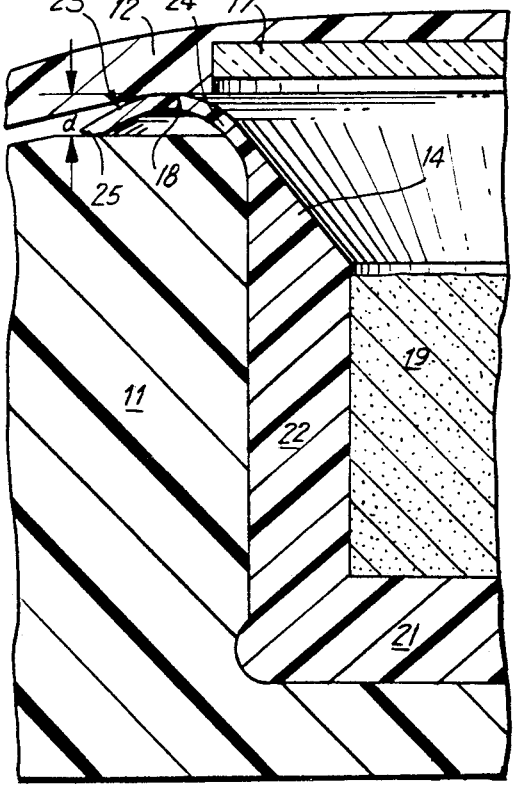

AIR TIGHT CONTAINER

CROSS-REFERENCE TO RELATED APPLICATIONS

This is a continuation of application Ser. No. 594,006, filed Mar. 27, 1984, which is a continuation-in-part of application Ser. No. 480,620, filed Mar. 30, 1983.

BACKGROUND OF THE INVENTION

This invention relates to an improved air-tight container, and more particularly to an air-tight container for storing cosmetic material.

Various types of cosmetics containers having seals for preventing spillage of the contents are well known in the art. Many of these prior art constructions include a deformable sealing material which is disposed about an interior pan. For example, U.S. Pat. No. 2,033,295 (Parkin) and U.S. Pat. No. 1,912,187 (Fullmer) provide a ring of compressable packing material about the pan for providing a substantially leak-proof seal. The Parkin patent forms a tray with a flange which sits on the packing material. When the container lid is closed it compresses against the packing material. Similarly, the Fullmer patent provides a ring of cork about the interior cavity for receiving a closure.

Several other types of constructions include deformable material disposed in the top of the container. In this type of construction a vertically extending wall of the base compresses the deformable material for forming ,the seal. U.S. Pat. Nos. 2,123,501, No. 1,872,864, No. 1,641,650, No. 1,575,524 and No. 325,872 are illustrative. Both U.S. Pat. Nos. 2,656,090 and No. 2,342,200 provide closure by overlapping the top and bottom of the cohtainer.

In each of the prior art constructions the deformable material is a separate element which increases production costs and tends to lower reliability of the seal. Accordingly, it would be desirable to provide an improved air-tight container constructions, including a construction wherein the air-tight seal can be formed integrally with a dish for holding the contents which is inserted into the container base.

SUMMARY OF THE INVENTION

Generally speaking, in accordance with the invention, an improved container for providing an air-tight seal is provided. The container is particularly well suited for storing cosmetic materials including solvents which require precaution against evaporation.

The container includes a container bottom formed with a cavity for holding the cosmetic material and a container top openably mounted to the bottom. The container top and bottom are formed with overlapping locking regiorsto maintain the container in a securely closed position, yet be openable easily. A deformable flange with a base and a lip section is attached to one of the interior faces of the container. When the container is closed, the lip section is deformed and compressed against the other interior face for creating the air-tight seal.

In a preferred embodiment, a dish is mounted in the container bottom and is formed with a side wall which extends above the top surface of the container bottom. The side wall terminates with an outwardly extending flange which is thin enough to be deformed by the container top when the container is closed. The flange is a thin outwardly extending flange which extends outwardly and turns downwardly towards the container base. The dish may be force fit or glued into a well formed in the container bottom. The container top mates with and compresses the flange for forming the air-tight seal. The flange must be fabricated thin enough to be deformed when compressed by the container top. The pan insert may be formed of any synthetic material which can be deflected by the container top.

Accordingly, it is an object of the invention to provide an improved container with an air-tight seal.

It is also an object of the invention to provide an improved air-tight container having a deflectable lip mounted in one side for providing the seal.

Another object of the invention is to provide an improved container having an air-tight seal wherein the seal is provided without use of a separate deformable element.

A further object of the invention is to provide an improved container having an air-tight seal including a dish insert having a deformable flange.

Still another object of the invention is to provide an improved container which is air-tight and which is easily assembled.

Still a further object of the invention is to provide an improved container for cosmetic material with an air-tight seal.

Yet another object of the invention is to provide an improved cosmetic compact with an air-tight seal.

Still other objects and advantages of the invention will in part be obvious and will in part be apparent from the specification.

The invention accordingly comprises an article of manufacture possessing the features, properties and the relation of elements which will be exemplified in the article hereinafter described and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a perspective view of an air-tight container constructed and arranged in accordance with the invention in an open condition;

FIG. 2 is a partial cross-sectional view of the container and a dish insert taken through line 2—2 in FIG. 1;

FIG. 3 is a perspective view of the bottom of the container illustrated in FIG. 1 in a closed position;

FIG. 4 is a partial cross-sectional view of the container and pan insert of FIG. 1 in a closed position illustrating the air-tight seal formed by deflection of the dish flange taken through line 4—4 of FIG. 3;

FIG. 5 is a partial cross-sectional view of the compact of FIGS. 1–4 in a closed position taken along line 5–4 of FIG. 3;

DESCRIPTION OF THE PREFERRED EMBODIMENTS

Figure 6:
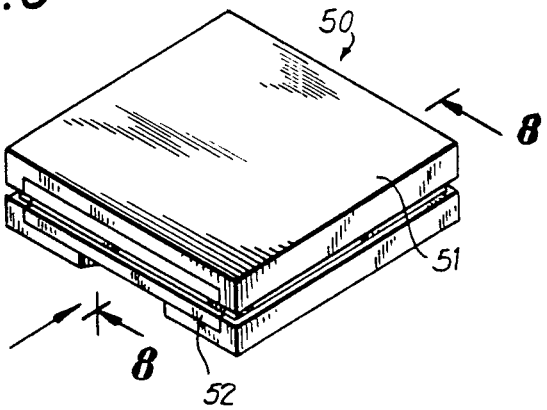
FIG. 6 is a perspective view of a conventional commercially available compact.

FIG. 1 illustrates an improved air-tight cosmetic container 10 constructed and arranged in accordance with the invention in an open condition. Container 10 includes a bottom 11 and a top 12 hinged to bottom 11 by a hinge 13. A dish 14 for holding a material to be stored within container 10 is mounted within a well 16 formed in container bottom 11. In the embodiment illustrated in FIG. 1, container 10 also includes a circular mirror 17 mounted within container top 12 for convenience of a user. Mirror 17 has a somewhat smaller diameter than dish 14. In the region of container top 12 outside mirror 17, top 12 is formed with a substantially flat circular region 18 which cooperates with a flange 23 formed in dish 14 for forming the air-tight closure as will be described in detail.

FIG. 2 is a partial cross-sectional view of container 10 taken along line 2—2 of FIG. 1. The section is through a portion of container bottom 11 and dish 14 and shows a portion of a cosmetic material 19 stored within dish 14. Dish 14 provides a substantially cylindrical storage area and is formed with a base 21 and a substantially vertical side wall 22 extending from base 21. Side wall 22 terminates in outwardly extending flange 23 which incudes an upwardly extending thin wall 24 and a downwardly facing thin lip 25. Flange region 23 is shown to extend above the top surface of container base 11; however, flange region 23 need only extend to a height sufficient to be deflected by container top 12 or an extension thereon when container top is closed. Dish 14 is secured in well 16 by a force fit, glue or a heat seal including sonic welding. The sole limitation on the construction of dish 14 is that flange 23 be formed sufficiently thin or of material which is deflected when compressed by container top 12 and teturn to its original position when container 12 is opened.

Dish 14 may be formed from any convenient polymeric material which is deformable when molded. Dish 14 is preferably formed of a polyolefin, such a polyethylene, polypropylene, a polyester, such as polybutylene terephthalate (PBT) or polyethylene terephthalate (PET), or a vinyl or nylon material. Of course, the material selected must be inert to any material stored within dish 14.

In order to provide an air-tight closure, container bottom 11 is formed with a cut-out region 26 and an outwardly facing lip 27. Container top 12 is formed with a cooperating cut-out region 28 and an inwardly facing lip 29 for engaging outwardly facing lip 27 when top 12 is pivoted about hinge 13 to close container 10. Cut-out regions 26 and 28 provide convenient points of leverage to open container 10 by disengaging lips 27 and 29.

When container 10 is closed circular portion 18 on the inside surface of container top 12 engages the top of flange region 23 of dish 14 at point A and displaces it towards containenr bottom 11. In this embodiment, downwardly extending lip 25 of flange region 23 is displaced outwardly and the top of flange 23 is compressed firmly by flat region 18 of container top 12. This compression of flange region 23 of dish 14 provides an air-tight seal for cosmetic material 19 stored in container 10. As shown in FIG. 4 the distance between parallel portions of container top 12 and container bottom 11 identified as d is less than the distance d' in FIG. 2 that flange region 23 of dish 14 extends above the top surface of container bottom 11. When container 10 is in this closed position, container top 12 maintains flange 23 in the deflected position due to the locking closure of outwardly extending lip 27 of bottom 11 and inwardly extending lip 29 of top 12.

Accordingly, by providing a dish or pan insert having a deformable flange for a cosmetic container, air-tight properties may be obtained with relative ease. In contrast to the typical prior art constructions, an additional deformable gasket or insert is not necessary as the container top is adapted to compress the flange on the dish for providing the air-tight seal when the container is closed. The flange region may be deflected by a flat portion as shown in the exemplary embodiment or the flange region may be substantially planar and deflected by a projection on the top. The efficacy of this construction has been demonstrated on an experimental basis. The following results are presented solely by way of illustration.

Figure 7:
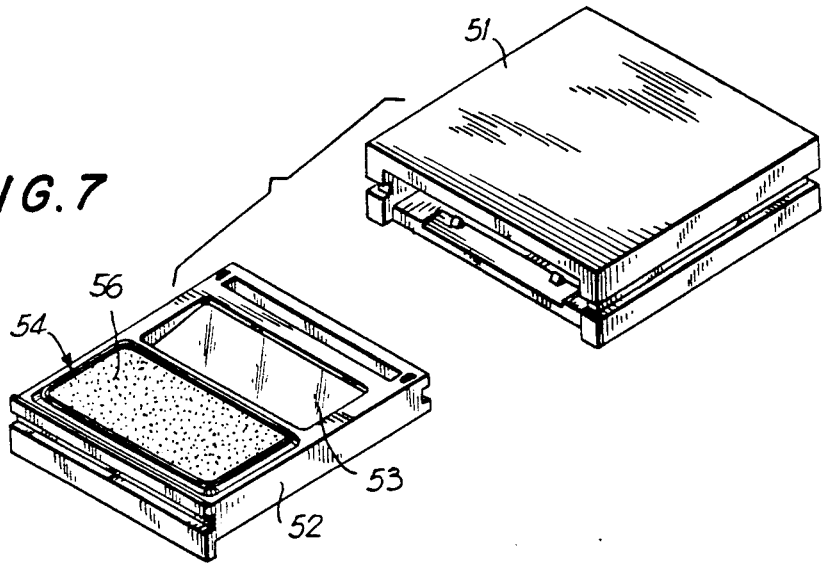
FIG. 7 is an exploded perspective view of the compact of FIG. 6 showing a compact drawer and housing.
Figure 8:
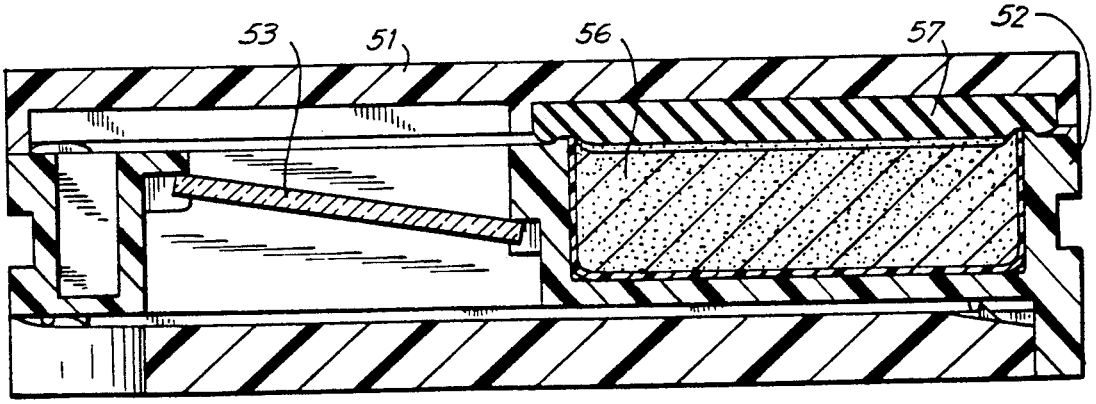
FIG. 8 is a cross-sectional view of the compact of FIG. 6 taken along line 8–8.

Comparative evaporation studies demonstrating the advantages attained in accordance with the invention were performed. Yves St. Laurent Solvent Eye Shadow is available in a compact 50 as illustrated in FIGS. 6–8. Compact 50 includes a housing 51 and a slideably openable drawer 52 shown in the exploded view of FIG. 7. Drawer 52 includes a mirror 53 and a dish 54 for holding a cosmetic material 56. When drawer 52 is closed within housing 51 the edges of dish 54 compress a deformable sealing material 57 mounted within housing 51. Compact 50 was selected for the comparative evaluation studies as compact 50 is used to store a cosmetic product including a solvent which requires precautions against evaporation.

An Estee Lauder Solvent Eye Shadow composition was stored in an air-tight container 10 of the type illustrated in FIGS. 1–5. The same composition was stored in a Yves St. Laurent compact 50 as illustrated in FIGS. 6–8. The following results in weight loss were obtained over the time periods indicated.

| Time | % Loss in YSL Container 50 | % Loss in EL Container 10 |
|---|---|---|
| 1 week | 6.8% | 1.2% |
| 2 weeks | 10.0% | 1.3% |
| 3 weeks | 10.0% | 1.8% |
| 4 weeks | 12.4% | 2.6% |

As noted above, the YSL container 50 was selected for this test because it is used to store a cosmetic composition including a solvent which requires precautions against evaporation. Moreover, container 50 includes a deformable sealable material 57 of the type utilized in the prior art constructions. The reduced weight loss in container 10 constructed and arranged in accordance with the invention demonstrates by a substantially reduced weight loss over an extended period of time that the advantages obtained in accordance with the invention are indeed substantial.

Figure 9:
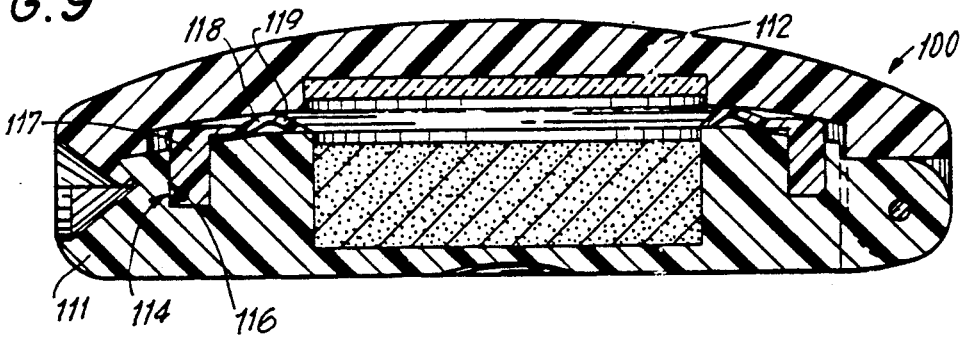
FIG. 9 is a cross-sectional view of a compact prepared in accordance with another embodiment of the invention.

Referring now to FIG. 9, a compact 100 having the same outward appearance and compact 10 of FIGS. 1–5 is shown in cross-section. Compact 100 is of substantially similar construction to compact 10. Compact 100 includes a top 112 hinged to a bottom 111 with a deformable sealing member 114 mounted in a circular trough 116 formed in bottom 111. Sealing member 114 is formed with a base 117 and a deformable lip 118 having a curved end 119. Sealing member 114 functions in the same manner as flange region 23 of container 10 except that lip 119 is disposed inwardly towards the center of container 100.

Figure 10:
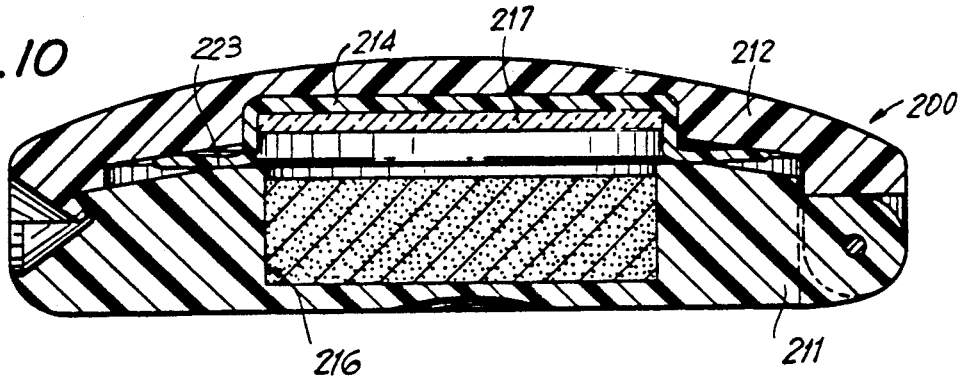
FIG. 10 is a cross-sectional view of a compact in accordance with a further embodiment of the invention.

FIG. 10 illustrates a container 200 having a top 212 and a bottom 211 formed with a well 216. In this embodiment of the invention a sealing member 214 is disposed about a mirror 217 in top 212. Sealing member 214 is formed with an outwardly extending flange portion 223 to provide an air-tight seal in the same manner as flange portion 23 in container 10.

Figure 11:
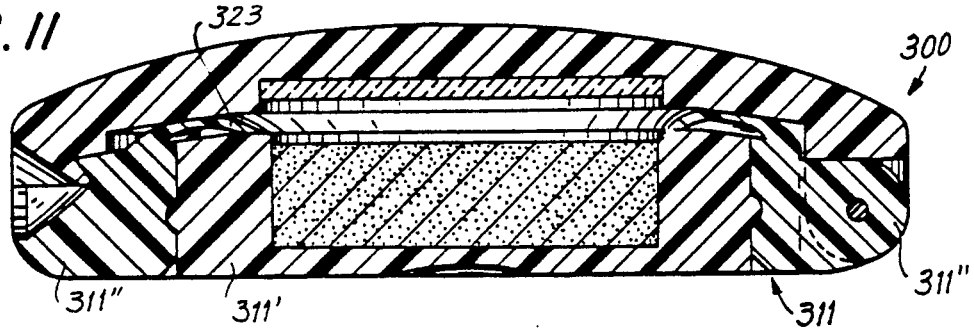
FIG. 11 is a cross-sectional view of a compact in accordance with still another embodiment of the invention.

In the embodiment illustrated in FIG. 11 a container 300 prepared in accordance with a further embodiment of the invention as shown. In this embodiment, a container bottom 311 is formed of two pieces, an interior cylindrical piece 311' and an outer anular piece 311". The combination of inner piece 311' and outer 311" form a container bottom similar in shape to the previous embodiments. OPuter annular piece 311" is formed with an inwardly facing flange portion 323 extending from the top surface of outer portion 311". Flange portion 323 has an upwardly extending thin wall and a downwardly extending thin lip to provide an air-tight seal in the same manner as in container 10.

Figure 12:
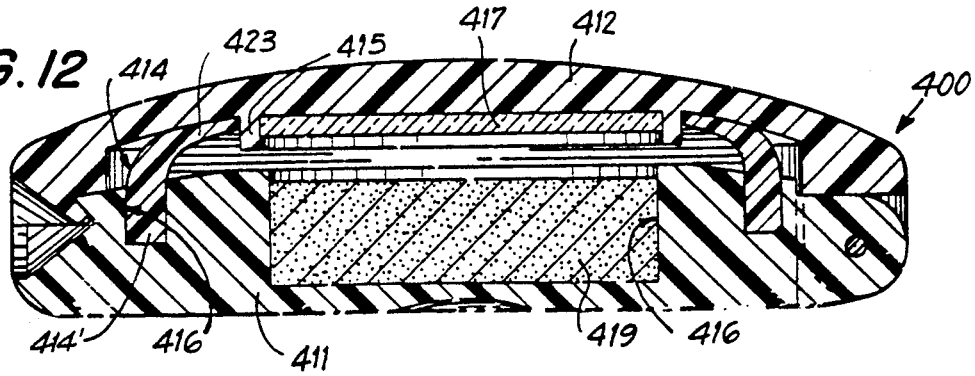
FIG. 12 is cross-sectional view of a compact prepared in accordance with yet a further object of the invention.

FIG. 12 illustrates yet another container 400 constructed and arranged in accordance with the invention. In this embodiment sealing member 414 mounted in bottom 411 is formed with a base portion 414' terminating in an upwardly and inwardly curving thin flange 423. Sealing member 414 is mounted in annular trough 416 formed in bottom 411 about a well 416 for holding a material 419.

Top 412 is formed with a downwardly facing annular wall 415 for receiving a mirror 417 interior thereof. When container top 412 is closed, flange portion 423 is deformed and compressed against wall 415 in top 412 to provide the air-tight seal.

Accordignly, by providing a cosmetic container having a deformable flange mounted in the top or bottom of the container provides air-tight properties by being deformed against the opposite member. The constructions in accordance with the invention satisfy a long felt need and avoid the use of separate deformable gasket-type materials for providing the seal as is often done in the prior art. The constructions in accordance with the invention provide for ease, flexiblity and economy in manufacture.

It will thus be seen that the objects set forth above, among those made apparent form the preceding description, are efficiently attained and, since certain changes may be made in the above article without departing from the spirit and scope of the invention, it is intended that all matter contained in the above description and shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A container having improved air tight properties when closed, comprising:

a container bottom formed with a well for receiving a product to be stored in the container;

a top openably mounted to the bottom for selectively opening and closing the container;

said container formed with closure means for maintaining the container in a securely closed position when the top is displaced towards and contacts the bottom; and a deformable sealing member securely mounted in one of the top or bottom and having a base and a flange member extending upwardly away from the mounting surface of the top or bottom, inclined inwarldy towards the center of the container and curving downwardly towards the mounting surface the flange member adapted to be deflected by the interior of the top or bottom member towards the other member when the container is closed by the top being displaced towards the bottom and the flange member maintained in its deflected condition with the downward portion compressed by the mounting surface and the upwad portion compressed by the opposite member at points at different distances from the portion of the sealing member secured in the mounting surface when the closure means secures the container in its closed position.

2. A container having improved air tight properties when closed, comprising:

a container bottom formed with a well for receiving a product to be stored in the container;

a top openably mounted to the bottom for selectively opening and closing the container;

said container formed with closure means for maintaining the container in a securely closed position when the top is displaced towards and contacts the bottom; and a deformable sealing member securely mounted in the to of the container and having a base and a flange member extending upwardly away from the mounting surface of the top or bottom and curving downwardly towards the mounting surface the flange member adapted to be deflected by the interior of the top or bottom member towards the other member when the container is closed by the top being displaced towards the bottom and the flange member maintained in its deflected condition with the downward portion compressed by the mounting surface and the upward portion compressed by the opposite member at points at different distances from the portion of the sealing member secured in the mounting surface when the closure means secures the container in its closed position.

3. A container having improved air-tight properties when closed, comprising:

a container bottom formed with a well for receiving a product to be stored and an annular formed about the well;

a top openably mounted to the bottom for selectively opening and closing the container;

said container formed with closure means for maintaining the container in a securely closed position when the top is displaced towards and contacts the bottom; and a flexible sealing member having a sidewall with a flange member extending above the top surface of the container bottom and away from the sidewall, the flange extending upwardly away from the bottom and curving downwardly towards the bottom, the sidewall fixedly secured in the annular groove and flange member adapted to be deflected by the interior of the top towards the container bottom when the container is closed by the top being displaced towards the bottom and the flange member maintained in its deflected condition compressed at the upward portion by the top when the closure means secures the container in its closed position.

4. A container having improved air-tight properties when closed, comprising:

a container bottom formed with a well for receiving a product to be stored;

a top openably mounted to the bottom for selectively opening and closing the container, said top formed with a recess opposed to the well in the bottom;

said container formed with closure means for maintaining the container in a securely closed position when the top is displaced towards and contacts the bottom; and an inverted cup fixedly secured in the recess in the top, the inverted cup having a side wall extending above the surface of the top and a flange member extending away from the sidewall with a first portion extending away from the top and a second peripheral portion curving towards the top, the flange member adapted to be deflected by the interior of the bottom towards the container top when the container is closed by the top being displaced towards the bottom and the flange member maintained in the deflected condition with the first portion compressed by the container bottom and the peripheral portion compressed by the top when the closure means secures the container in its closed position.

5. The air-tight container of claim 4, further including a mirror mounted in the inverted cup.

6. A container having improved air-tight properties when closed, comprising:

a container bottom formed from a center portion having a well for receiving a product to be stored therein and an outer annular portion joined to the center position.

a top openably mounted to the outer portion of the bottom for selectively opening and closing the container;

said container formed with closure means for maintaining the container in a securely closed position when the top is displaced towards and contacts the bottom; and the outer portion of the bottom is formed with an extending flange member extending above the top surface of the bottom, the flange member adapted to be deflected by the interior of the top towards the bottom when the container is closed by the top being displaced towards the bottom and the flange member maintained in the deflected condition when the upward portion is compressed by thet op when the closure means secures the container in its closed position.

* * * * *